US008781717B2

(12) United States Patent
Miyajima et al.

(10) Patent No.: US 8,781,717 B2
(45) Date of Patent: Jul. 15, 2014

(54) TRAFFIC INFORMATION CREATING DEVICE, TRAFFIC INFORMATION CREATING METHOD AND PROGRAM

(71) Applicants: Takayuki Miyajima, Anjo (JP); Satoshi Hirano, Okazaki (JP); Kiyokazu Okada, Miyoshi (JP)

(72) Inventors: Takayuki Miyajima, Anjo (JP); Satoshi Hirano, Okazaki (JP); Kiyokazu Okada, Miyoshi (JP)

(73) Assignee: Aisin AW Co., Ltd., Anjo (JP)

( * ) Notice: Subject to any disclaimer, the term of this patent is extended or adjusted under 35 U.S.C. 154(b) by 0 days.

(21) Appl. No.: 13/789,044

(22) Filed: Mar. 7, 2013

(65) Prior Publication Data

US 2013/0253810 A1 Sep. 26, 2013

(30) Foreign Application Priority Data

Mar. 21, 2012 (JP) ..... 2012-063211

(51) Int. Cl.
*G08G 1/00* (2006.01)

(52) U.S. Cl.
USPC ..... 701/118

(58) Field of Classification Search
None
See application file for complete search history.

(56) References Cited

U.S. PATENT DOCUMENTS

| | | | | |
|---|---|---|---|---|
| 6,650,948 | B1 * | 11/2003 | Atkinson et al. | 700/66 |
| 2008/0077316 | A1 | 3/2008 | Yamane et al. | |
| 2008/0234922 | A1 | 9/2008 | Ishikawa et al. | |
| 2010/0138141 | A1 * | 6/2010 | Hayashida et al. | 701/118 |
| 2011/0276257 | A1 * | 11/2011 | Zaitsu et al. | 701/117 |
| 2012/0029801 | A1 | 2/2012 | Yano et al. | |

FOREIGN PATENT DOCUMENTS

| | | |
|---|---|---|
| EP | 2 006 818 A1 | 12/2008 |
| EP | 2 287 821 A1 | 2/2011 |
| JP | A-2008-234162 | 10/2008 |

OTHER PUBLICATIONS

Sep. 13, 2013 Extended European Search Report issued in European Patent Application No. 13158241.3.

* cited by examiner

*Primary Examiner* — John R Olszewski
*Assistant Examiner* — Navid Ziaeianmehdizadeh
(74) *Attorney, Agent, or Firm* — Oliff PLC

(57) ABSTRACT

Devices, methods, and programs determine whether a vehicle has exited a link based on map information. If so, the devices, methods, and programs acquire a travel traffic congestion level of the exited link based on travel information within the exited link, and determine whether the travel traffic congestion level of the exited link coincides with a distributed traffic congestion level at a time when the vehicle exited. If not, the devices, methods, and programs determine whether the traffic information has been updated and the distributed traffic congestion level has been changed within the exited link, and if so, acquire a distribution time rate of each distributed traffic congestion level within the exited link. The devices, methods, and programs determine a traffic congestion level of the exited link based on the distribution time rate of each acquired distributed traffic congestion level and the travel traffic congestion level of the exited link.

15 Claims, 8 Drawing Sheets

71

| LINK ID | MANAGEMENT NUMBER | TRAFFIC CONGESTION LEVEL | NUMBER OF TRAVELS | CONSUMPTION ENERGY |
|---|---|---|---|---|
| XX101 | 1 | HEAVY CONGESTION | 1 | 100 cc |
| | 2 | HEAVY CONGESTION | 2 | 150 cc |
| | 3 | NO CONGESTION | 1 | 60 cc |
| | 4 | HEAVY CONGESTION | 3 | 120 cc |
| YY105 | 1 | HEAVY CONGESTION | 1 | 110 cc |
| | 2 | HEAVY CONGESTION | 2 | 160 cc |
| | 3 | NO CONGESTION | 1 | 65 cc |
| | 4 | HEAVY CONGESTION | 3 | 130 cc |
| | 5 | NO CONGESTION | 2 | 55 cc |
| .... | ... | .... | .... | .... |

FIG. 4

72

| ROAD TYPE / TRAFFIC CONGESTION LEVEL | INTERURBAN EXPRESSWAY | URBAN EXPRESSWAY | ORDINARY ROAD |
|---|---|---|---|
| HEAVY CONGESTION | LOWER THAN 40 km/h | LOWER THAN 20 km/h | LOWER THAN 10 km/h |
| CONGESTION | 40 km/h OR HIGHER LOWER THAN 60 km/h | 20 km/h OR HIGHER LOWER THAN 40 km/h | 10 km/h OR HIGHER LOWER THAN 20 km/h |
| NO CONGESTION | 60 km/h OR HIGHER | 40 km/h OR HIGHER | 20 km/h OR HIGHER |

TRAFFIC INFORMATION CREATING DEVICE, TRAFFIC INFORMATION CREATING METHOD AND PROGRAM

INCORPORATION BY REFERENCE

The disclosure of Japanese Patent Application No. 2012-063211, filed on Mar. 21, 2012, including the specification, drawings, and abstract is incorporated herein by reference in its entirety.

BACKGROUND

1. Related Technical Fields

Related technical fields include traffic information creating devices, traffic information creating methods, and programs that create traffic information of a passage link.

2. Related Art

Various techniques for creating traffic information of a passage link have been suggested so far. There is a traffic situation computing system (for example, see Japanese Patent Application Publication No. 2008-234162 (JP 2008-234162 A)). The traffic situation computing system is configured as follows. For example, at the time of computing the traffic congestion levels of links on the basis of probe data collected from probe cars, the traffic congestion levels are detected by changing a set of thresholds for classifying the traffic congestion levels (heavy congestion, congestion, no congestion) by predetermined vehicle speeds, the detected traffic congestion levels are compared with traffic congestion levels based on traffic information in units of secondary mesh for a coincidence rate, and the set of thresholds having the highest coincidence rate are selected. Then, the traffic congestion levels of the respective links in an intended secondary mesh are detected on the basis of the selected set of thresholds and are stored.

SUMMARY

In the traffic situation computing system described in JP 2008-234162 A, the traffic congestion levels of the respective links, detected by changing the set of thresholds for classifying the traffic congestion level, are compared with the traffic information delivered at predetermined time intervals, and the traffic congestion levels of the respective links are detected on the basis of the set of thresholds having the highest coincidence rate. However, if the traffic information has been updated on the way of passage of any one of the links, the accuracy of detecting the traffic congestion level of that link may decrease.

Exemplary implementations of the broad inventive principles described herein provide a traffic information creating device, traffic information creating method and program that, even when traffic information has been updated on the way of passage of a link, are able to highly accurately determine the traffic congestion level of that link.

Exemplary implementations provide devices, methods, and programs that acquire travel information including a current location of a vehicle and its speed at unit time intervals, acquire traffic information including a distributed traffic congestion level of each link that is distributed from a device outside the vehicle at predetermined time intervals, and determine whether the vehicle has exited a link based on the map information. When it is determined that the vehicle has exited a link, the devices, methods and programs acquire a travel traffic congestion level of the exited link based on the travel information within the exited link, and determine whether the travel traffic congestion level of the exited link coincides with the distributed traffic congestion level at a time at which the vehicle exited the link. When it is determined that the travel traffic congestion level of the exited link does not coincide with the distributed traffic congestion level at the exit time, the devices, methods, and programs determine whether the traffic information has been updated and the distributed traffic congestion level has been changed within the exited link, and if so, acquire a distribution time rate of each distributed traffic congestion level within the exited link. The devices, methods, and programs determine a traffic congestion level of the exited link based on the distribution time rate of each acquired distributed traffic congestion level and the travel traffic congestion level of the exited link and store the traffic congestion level of the exited link in association with the exited link.

BRIEF DESCRIPTION OF THE DRAWINGS

FIG. 4 is a view that shows an example of a traffic congestion level computing table that is stored in the traffic information DB;

DETAILED DESCRIPTION OF THE EXEMPLARY IMPLEMENTATIONS

Hereinafter, an example in which the traffic information creating device, the traffic information creating method, and the program are applied to a navigation system will be described in detail with reference to the accompanying drawings.

1. Schematic Configuration of Navigation System

Figure 1:
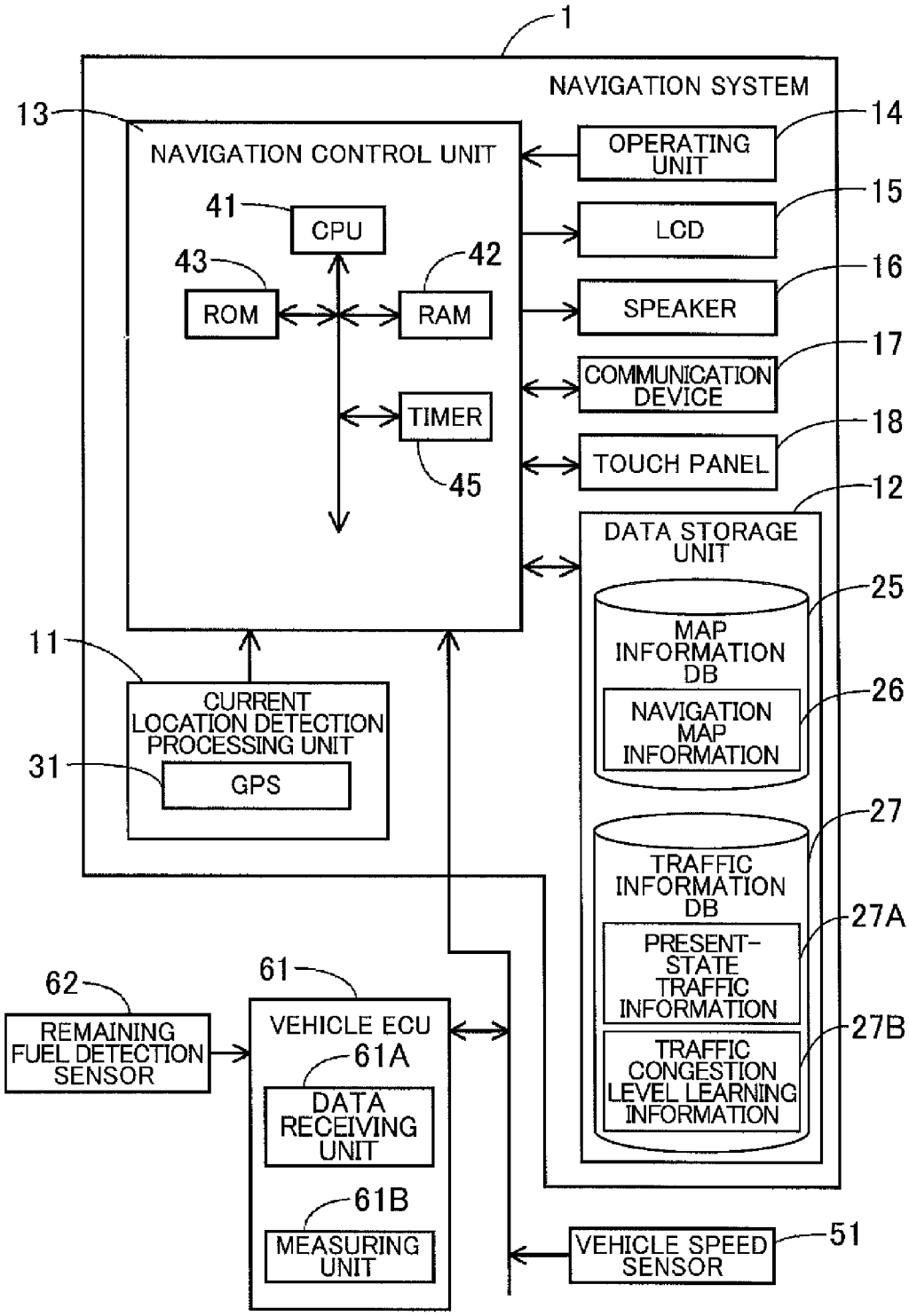
FIG. 1 is a block diagram that shows an example of the configuration of a navigation system according to an example.
Figures 2, 3:
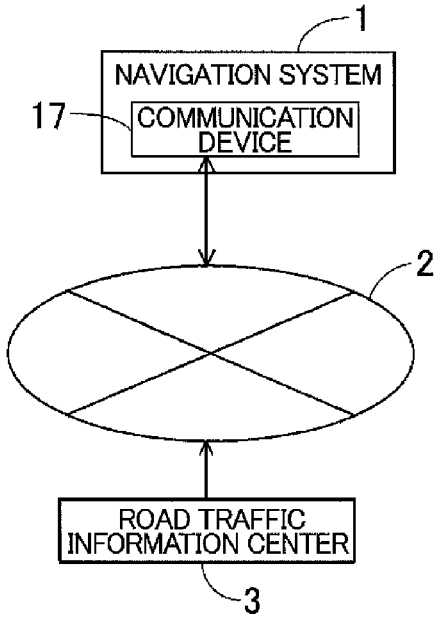
FIG. 2 is an explanatory view that illustrates communication between the navigation system and a road traffic information center.
FIG. 3 is a view that shows an example of a traffic congestion level learning table that is stored in traffic congestion level learning information of a traffic information DB.

First, the schematic configuration of the navigation system according to the present example will be described with reference to FIG. 1 and FIG. 2. FIG. 1 is a block diagram that shows the navigation system 1 according to the present example. FIG. 2 is an explanatory view that illustrates communication between the navigation system 1 and a road traffic information center 3.

As shown in FIG. 1, the navigation system 1 according to the present example is formed of a current location detection processing unit 11, a data storage unit 12, a controller (e.g., navigation control unit 13), an operating unit 14, a liquid crystal display (LCD) 15, a speaker 16, a communication device 17 and a touch panel 18. The current location detection processing unit 11 detects the current location, or the like, of a host vehicle. Various data are stored in the data storage unit 12. The navigation control unit 13 executes various types of arithmetic processing on the basis of input information. The operating unit 14 accepts operator's operation. The liquid crystal display (LCD) 15 shows information about a map, or the like, to the operator. The speaker 16 outputs voice guidance associated with a route guide, or the like. The communication device 17 communicates with the road traffic information center 3, a map information distribution center (not shown), or the like, via a mobile telephone network, or the like. The touch panel 18 is attached to the surface of the liquid crystal display 15. In addition, a vehicle speed sensor 51 is connected to the navigation control unit 13. The vehicle speed sensor 51 detects the travel speed of the host vehicle.

In addition, a vehicle electronic control unit (ECU) 61 is electrically connected to the navigation control unit 13. The vehicle ECU 61 detects the remaining level of fuel with the use of a remaining fuel detection sensor 62. The vehicle ECU 61 includes a data receiving unit 61A and a measuring unit 61B. The data receiving unit 61A receives control information transmitted from the navigation control unit 13. The measuring unit 61B measures the remaining level of fuel with the use of the remaining fuel detection sensor 62 on the basis of the received control information, and then outputs the measured remaining level of fuel. By so doing, the navigation control unit 13 is able to measure a fuel consumption at the time when the vehicle has travelled each link by transmitting a control signal to the vehicle ECU 61.

In addition, as shown in FIG. 2, the road traffic information center 3 is connected to the navigation system 1 via a network 2. The road traffic information center 3 distributes traffic information and latest road information at predetermined time intervals (for example, intervals of five minutes). The traffic information is, for example, information such as traffic congestion of roads, which is created by collecting information from a traffic control system of the police, Japan Highway Public Corporation, or the like, and traffic regulation information. The latest road information includes VICS link IDs for identifying VICS (trademark) links associated with the respective pieces of traffic information. The network 2 may be a communication system such as a mobile telephone network, a telephone network, a public communication line network, a leased line network and a communication line network, such as the Internet.

The navigation system 1 is configured to be able to receive the latest road information distributed from the road traffic information center 3 via the network 2, at the predetermined time intervals (for example, intervals of five minutes). The traffic information that is included in the road information is, for example, detailed information about traffic information, such as road congestion information about the traffic congestion level of a road, or the like, and information on traffic regulation due to road work, construction work, or the like.

Roads (links) that are stored in navigation map info nation 26 are not the same as VICS links (generally, the roads (links) are more segmentalized than the VICS links). Therefore, a conversion table (cross-reference table) between a link ID assigned to each link as an identification number and a VICS link ID is stored in a map information DB 25, and it is possible to identify a corresponding link ID on the basis of a VICS link ID.

Hereinafter, component elements that constitute the navigation system 1 will be described. The current location detection processing unit 11 is formed of a GPS 31, and the like, and is able to detect a host vehicle location, a host vehicle direction, a travel distance, and the like. Note that a direction sensor (not shown), a distance sensor (not shown), and the like, may be connected to the current location detection processing unit 11.

The data storage unit 12 includes a hard disk (not shown), a flash memory (not shown), or the like, which serves as an external storage device and a storage medium, and also includes a driver (not shown) that is used to load the map information database (map information DB) 25, a traffic information database (traffic information DB) 27, predetermined programs, and the like, which are stored in the hard disk, or the like, and to write predetermined data to the hard disk, the flash memory, or the like.

The navigation map information 26 is stored in the map information DB 25. The navigation map information 26 is used in the navigation system 1 to guide a travel or search for a route. Present-state traffic information 27A that is information about a present state of traffic congestion, or the like, of a road is stored in the traffic information DB 27 each time traffic information is received from the road traffic information center 3. The present-state traffic information 27A is formed of the traffic congestion level, the actual length of traffic congestion, a required time, the cause of traffic congestion, expected time to free up traffic congestion, and the like, which constitute the received traffic information. Note that previous several pieces (for example, previous six pieces) of the present-state traffic information 27A are stored in the traffic information DB 27 together with respective dates of receipt, and are configured to be sequentially replaced with new traffic information each time traffic information is received from the road traffic information center 3.

A traffic congestion level learning table 71 (see FIG. 3) is stored in traffic congestion level learning information 27B of the traffic information DB 27. The traffic congestion level learning table 71 stores a traffic congestion level at the time when the vehicle has travelled each link, a fuel consumption at the time when the vehicle has travelled each link, and the like, in association with a link ID by which each link of the navigation map information 26 is identified. In addition, a traffic congestion level computing table 72 (see FIG. 4) is stored in the traffic information DB 27. The traffic congestion level computing table 72 stores traffic congestion levels and thresholds of the travel speeds of the vehicle, corresponding to the respective traffic congestion levels, for each road type.

The navigation map information 26 is formed of various pieces of information required to guide a route and display a map. The navigation map information 26 is, for example, formed of new road information, map display data, intersection data related to intersections, node data related to nodes, link data related to roads (links), search data, facility data, and retrieval data. The new road information is used to identify new roads. The map display data are used to display a map. The search data are used to search for a route. The facility data are related to point of interest (POI), such as a shop that is one of facilities. The retrieval data are used to retrieve a point.

For example, data about actual road branching points (including intersections, T-junctions, and the like), coordinates (positions) of nodes, node properties, connection link number lists, adjacent node number lists, and the like, are stored as the node data. The nodes are set on each road at an interval of a predetermined distance on the basis of a curvature radius, or the like. Each of the node properties, for example, indicates whether the node corresponds to an intersection. Each of the connection link number lists is a list of link IDs that are identification numbers of links that connect with the node. Each of the adjacent node number lists is a list of node numbers of nodes adjacent to each node via a link.

For example, data related to each link that constitutes a road, data related to a corner, data related to a road property, and data related to a road type are stored as the link data. The data related to each link indicate a link ID that identifies each link, a link length that indicates the length of each link, coordinate positions (for example, latitude and longitude) of the start point and end point of each link, presence or absence of a median strip, the width, gradient, cant, bank and road surface state of a road to which each link belongs, the number of lanes of the road, a point at which the number of lanes reduces, a point at which the width narrows, a crossing, and the like. The data related to a corner indicate a curvature radius, an intersection, a T-junction, an entrance and exit of the corner, and the like. The data related to a road property indicate a downhill, an uphill, and the like. The data related to a road type indicate not only an ordinary road, such as a national highway, a prefectural highway and a minor street, but also an interurban expressway, an urban expressway, and the like. The contents of the map information DB 25 are updated by downloading update information distributed from the map information distribution center (not shown) via the communication device 17.

As shown in FIG. 1, the navigation control unit 13 that constitutes the navigation system 1 includes a CPU 41, an internal storage device, a timer 45, and the like. The CPU 41 serves as a computing device and control device that comprehensively control the navigation system 1. The internal storage device is a RAM 42, a ROM 43, or the like. The RAM 42 is used as a working memory at the time when the CPU 41 executes various types of arithmetic processing. Route data, and the like, at the time when a route search has been made are stored in the RAM 42. Control programs, and the like, are stored in the ROM 43. The timer 45 measures a period of time. A program of a traffic congestion level storing process (see FIG. 5) is stored in the ROM 43. The traffic congestion level storing process stores a traffic congestion level of an exited link (described later) and a fuel consumption within the link in association with the link. (Note: the term "storage device" as used herein is not intended to encompass transitory signals.)

Various peripheral devices (actuators), that is, the operating unit 14, the liquid crystal display 15, the speaker 16, the communication device 17 and the touch panel 18, are electrically connected to the navigation control unit 13. The operating unit 14 is operated, for example, at the time when a start of travel is corrected and a current location at the time when a departure place that is a guide start point and a destination that is a guide end point are input or when information about a facility is retrieved. The operating unit 14 is formed of various keys and a plurality of operating switches. The navigation control unit 13 executes control for carrying out various operations on the basis of respective switch signals that are output by, for example, pressing down the switches.

Map information of an area in which the vehicle is currently travelling, map information of an area around a destination, an operation guide, an operation menu, a key guide, a recommended route from a current location to the destination, guide information along the recommended route, traffic information, news, weather forecast, time, mail, TV program, and the like, are displayed on the liquid crystal display 15.

The speaker 16 outputs voice guidance, or the like, that guides a travel along a recommended route on the basis of instructions from the navigation control unit 13. The voice guidance for a guide is, for example, "200 m ahead, turn right at □□ intersection."

The communication device 17 is a communication unit that uses a mobile telephone network, or the like, and that communicates with the road traffic information center 3, the map information distribution center (not shown), or the like. The communication device 17 receives latest traffic information distributed from the road traffic information center 3, and exchanges newest version updated map information, or the like, with the map information distribution center.

The touch panel 18 is a transparent panel-shaped touch switch attached onto the display screen of the liquid crystal display 15. The touch panel 18 is configured to be able to input various instruction commands by pressing down buttons or a map displayed on the screen of the liquid crystal display 15 and to be able to, when the display screen is pressed down with finger(s) and dragged, detect the moving direction and moving speed of each finger and detect the number of fingers with which the display screen is pressed down, for example. Note that the touch panel 18 may be formed of an optical sensor liquid crystal type, or the like, in which the screen of the liquid crystal display 15 is directly pressed down.

Next, an example of the traffic congestion level learning table 71 that is stored in the traffic congestion level learning information 27B of the traffic information DB 27 will be described with reference to FIG. 3. As shown in FIG. 3, the traffic congestion level learning table 71 is formed of "link ID," "management number," "traffic congestion level," "number of travels" and "consumption energy." The link IDs of the navigation map information 26 are stored as the "link ID."

A turn stored in association with each link ID is stored as the "management number." A traffic congestion level determined through the traffic congestion level storing process (see FIG. 5) and corresponding to each link ID is stored as the "traffic congestion level." The number of travels at each traffic congestion level is stored as the "number of travels." A fuel consumption at the time when the vehicle has travelled through the link is stored as the "consumption energy."

Note that, when the "number of travels" has reached a predetermined number of times (for example, "five" times) and then becomes the next number of travels (for example, "sixth" travel), data of which the "number of travels" at each traffic congestion level is the "first" travel are deleted, and then the "management number" and "number of travels" of each piece of data are decremented and stored. For example, data of the "second" to "fifth" travel are decremented to data of the "first" to "fourth" travel, and data of the "sixth" travel are stored as data of the "fifth" travel.

Next, an example of the traffic congestion level computing table 72 that is stored in the traffic information DB 27 will be described with reference to FIG. 4. As shown in FIG. 4, the traffic congestion level computing table 72 is formed of three types of traffic congestion levels, that is, "heavy congestion," "congestion" and "no congestion," and the thresholds of the travel speeds of the vehicle, corresponding to the respective traffic congestion levels. Furthermore, thresholds that vary on the basis of a road type (three types, that is, "interurban expressway," "urban expressway" and "ordinary road") are set as the thresholds of the travel speeds of the vehicle.

For example, when the road type is the "ordinary road," the threshold between the "heavy congestion" and the "congestion" is "10 km/h," and the threshold between the "congestion" and "no congestion" is "20 km/h." Thus, when the vehicle speed sensor 51 has detected that the vehicle has travelled along a link of an ordinary road at an average travel speed of "8 km/h," the traffic congestion level of that link is determined to be "heavy congestion."

2. Traffic Congestion Level Storing Process

Next, the traffic congestion level storing process will be described with reference to FIG. 5 to FIG. 9. The process algorithms in FIGS. 5-6B may be implemented in the form of one or more computer programs that are stored in, for example, a storage device included in the navigation system 1, and executed by the controller (e.g., navigation control unit 13). Although the structure of the above-described navigation device 1 is referenced in the description of the process, the reference to such structure is exemplary, and the process need not be limited by the specific structure of the navigation device 1.

Figure 5:
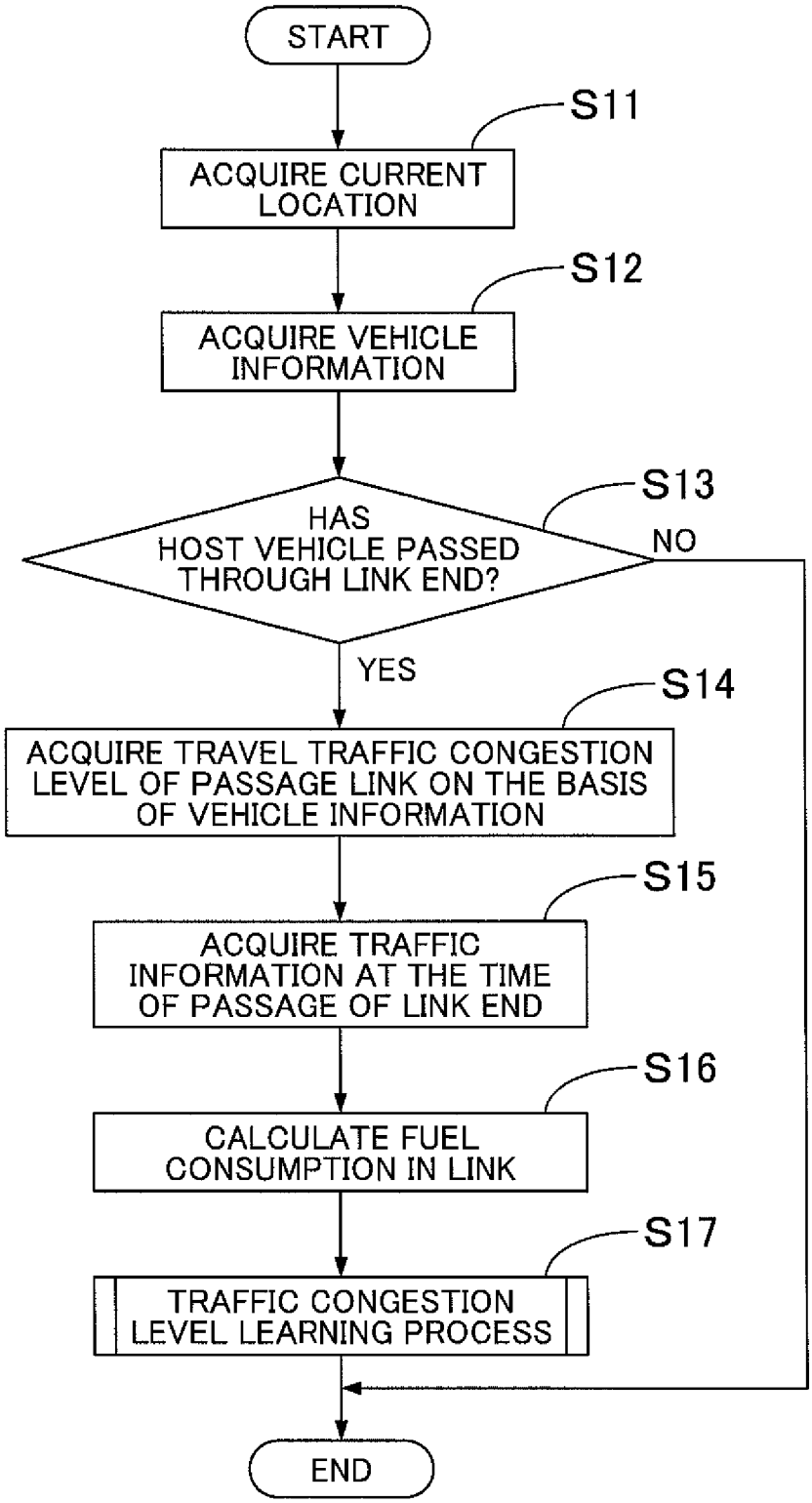
FIG. 5 is a main flowchart that shows a traffic congestion level storing process algorithm that stores a traffic congestion level of a travelled link in association with the link and that is executed by the navigation system.

A program shown by the flowchart in FIG. 5 may be executed by the CPU 41 at unit time intervals (for example, at intervals of one second). As shown in FIG. 5, first, in step (hereinafter, abbreviated as "S") 11, the CPU 41 detects the current location of the host vehicle (hereinafter, referred to as "host vehicle location") on the basis of the result detected by the current location detection processing unit 11 and stores the host vehicle location in the RAM 42.

In S12, the CPU 41 detects the travel speed of the host vehicle with the use of the vehicle speed sensor 51 and stores the travel speed in the RAM 42. The CPU 41 transmits a control signal to the vehicle ECU 61, acquires the remaining level of gasoline, detected by the remaining fuel detection sensor 62, and stores the remaining level of gasoline in the RAM 42. The CPU 41 calculates a fuel consumption by subtracting the current remaining level of gasoline from the last remaining level of gasoline, adds the calculated fuel consumption to the last fuel consumption, and stores the obtained fuel consumption in the RAM 42.

Subsequently, in S13, the CPU 41 loads the host vehicle location from the RAM 42, loads the "link ID" and "road type" of the currently travelling link and the "coordinate position of a forward travelling-side link end (end point)" from the navigation map information 26, and stores them in the RAM 42. The CPU 41 executes determination process of determining whether the host vehicle has passed through the link end (end point) of the currently travelling link, that is, whether the host vehicle has exited the link.

When it is determined that the host vehicle has not passed through the link end (end point) of the currently travelling link (NO in S13), the CPU 41 ends the process. On the other hand, when the host vehicle has passed through the link end (end point) of the currently travelling link, that is, when it is determined that the host vehicle has exited the link (YES in S13), the CPU 41 reads the current time from the timer 45, stores the time in the RAM 42 as the time at which the host vehicle has exited the link, and then proceeds with the process to S14.

In S14, the CPU 41 loads the vehicle speeds of the exited link, stored in the RAM 12 in S12, calculates the average speed of the loaded vehicle speeds and stores the average speed in the RAM 42 as the "travel speed" in the exited link. The CPU 41 loads the "road type" of the exited link from the RAM 42, and sets this road type as the "road type" of the traffic congestion level computing table 72 that is stored in the traffic information DB 27. The CPU 41 loads the thresholds of the travel speeds of the vehicle, corresponding to the respective traffic congestion levels, and stores the thresholds in the RAM 42.

Subsequently, the CPU 41 compares the "travel speed" in the exited link with the thresholds of the travel speeds of the vehicle, corresponding to the respective traffic congestion levels, detects the traffic congestion level (hereinafter, referred to as "travel traffic congestion level") corresponding to the "travel speed" of the exited link and stores the travel traffic congestion level in the RAM 42. For example, when the "travel speed" of the exited link is "30 km/h" and the "road type" of the exited link is the "ordinary road," the CPU 41 detects that the "travel traffic congestion level" of the exited link as the "no congestion" from the traffic congestion level computing table 72 and stores the travel traffic congestion level in the RAM 42. In S15, the CPU 41 loads the traffic congestion level of the link (hereinafter, referred to as "distributed traffic congestion level") from the present-state traffic information 27A at the time of passage of the link end, that is, at the time point at which the vehicle has exited the link, and stores the distributed traffic congestion level in the RAM 42. Subsequently, in S16, the CPU 41 loads the fuel consumption stored in the RAM 42 in S12, and stores the loaded fuel consumption in the RAM 42 again as the fuel consumption of the exited link. After that, in S17, the CPU 41 executes a sub-process (see FIGS. 6A and 6B) of a "traffic congestion level learning process" (described later), and then ends the process.

A. Traffic Congestion Level Learning Process

Figure 6A:
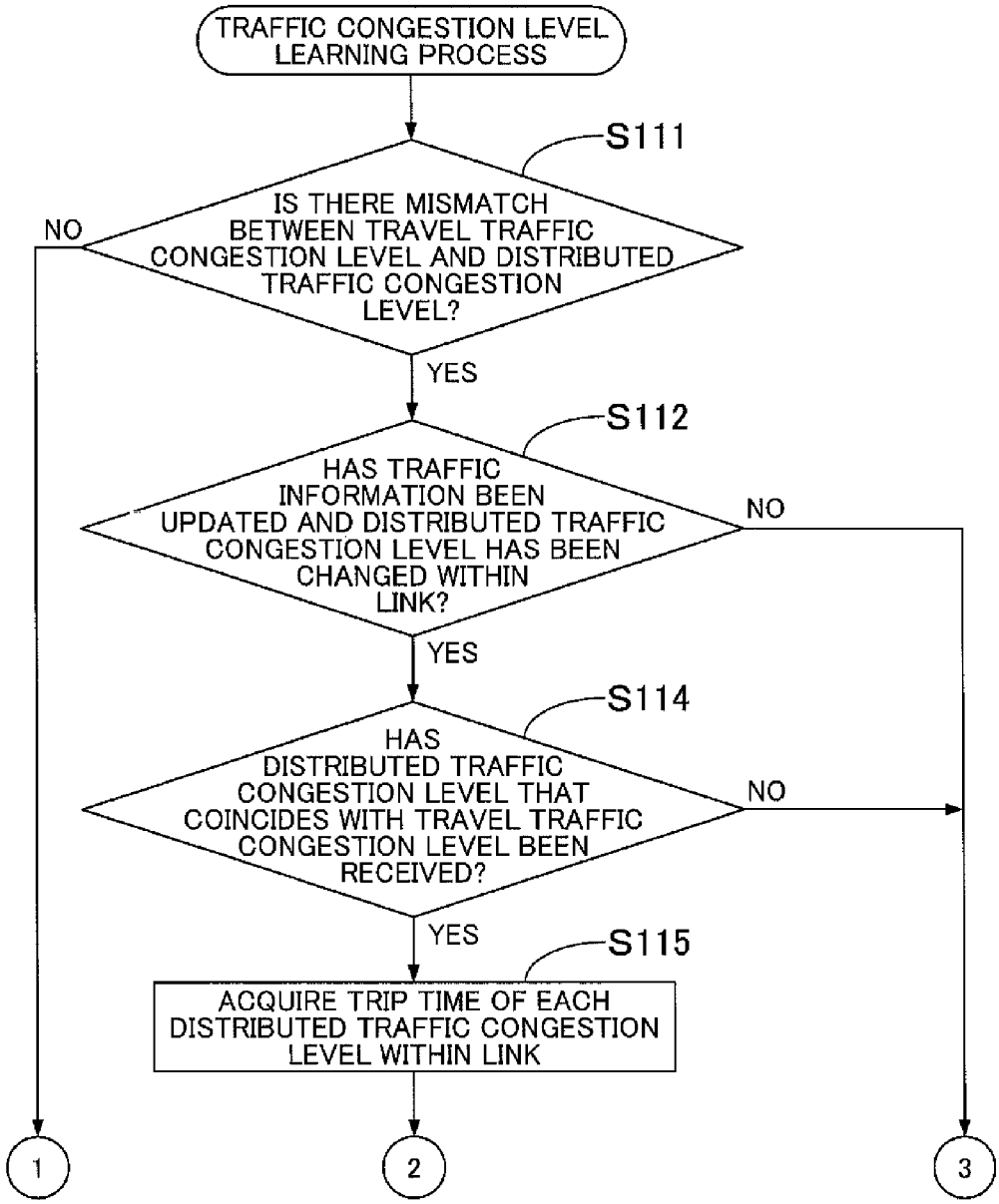
FIGS. 6A and 6B are a sub-flowchart that shows a sub-process algorithm of a traffic congestion level learning process shown in FIG. 5.
Figure 6B:
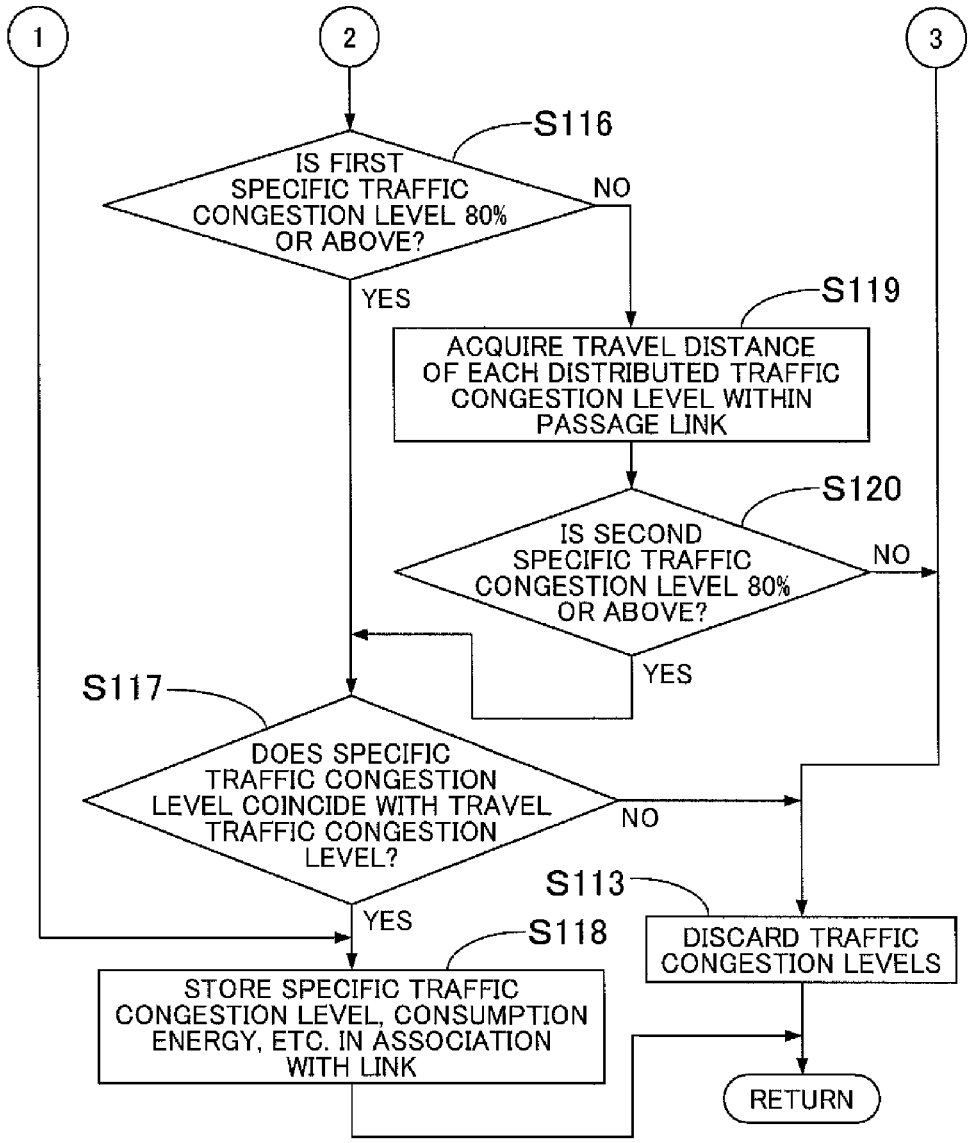

Next, the sub-process of the "traffic congestion level learning process" that is executed by the CPU 41 in S17 will be described with reference to FIGS. 6A and 6B to FIG. 9. As shown in FIGS. 6A and 6B, first, in S111, the CPU 41 loads the travel traffic congestion level and the distributed traffic congestion level from the RAM 42, and executes determination process of determining whether there is a mismatch between the travel traffic congestion level and the distributed traffic congestion level.

When it is determined that the travel traffic congestion level coincides with the distributed traffic congestion level (NO in S111), the CPU 41 stores the distributed traffic congestion level in the RAM 42 as a "specific traffic congestion level" of the exited link and then proceeds with the process to S118 (described later).

Figure 7:
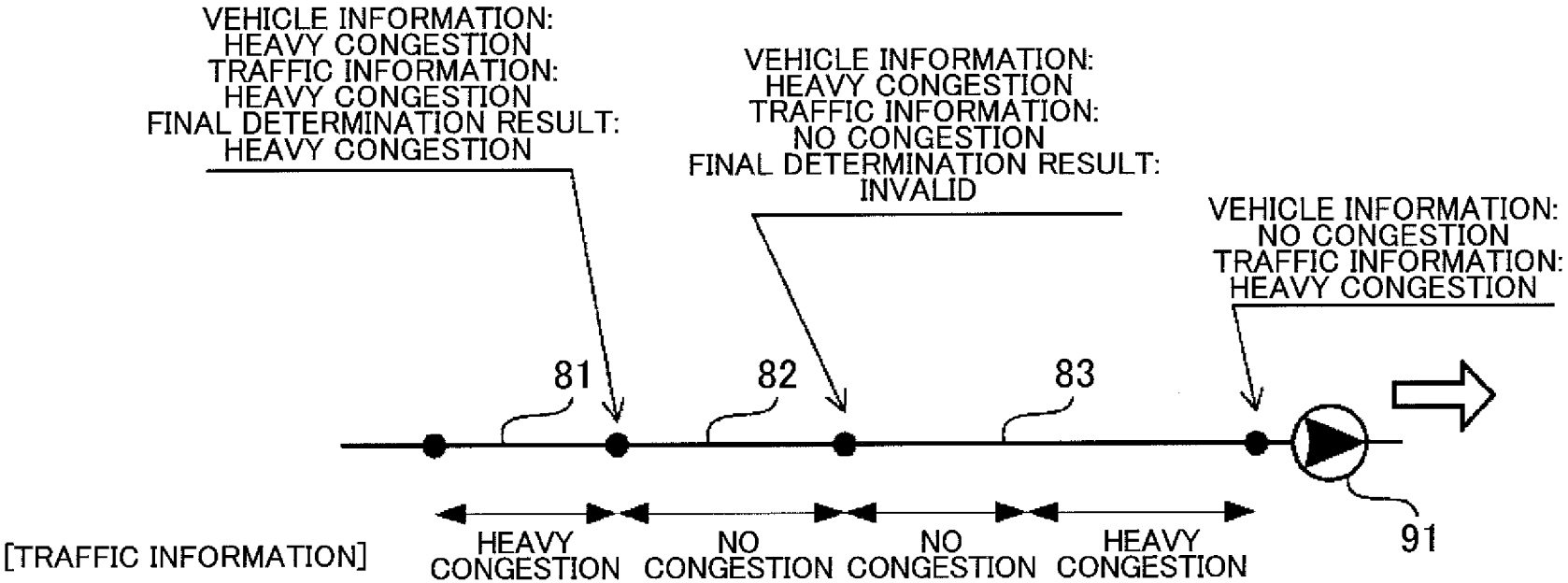
FIG. 7 is a view that shows an example in which a traffic congestion level of an exited link is determined.

For example, as shown at the left end in FIG. 7, when a "travel traffic congestion level" based on the travel speed in a link 81 from which a host vehicle 91 has exited is "heavy congestion" and a "distributed traffic congestion level" loaded from the present-state traffic information 27A at the time point at which the host vehicle 91 has exited the link 81 is "heavy congestion," the CPU 41 stores the "heavy congestion" of the "distributed traffic congestion level" in the RAM 42 as the "specific traffic congestion level" of the exited link and then proceeds with the process to S118 (described later).

On the other hand, when it is determined that there is a mismatch between the travel traffic congestion level and the distributed traffic congestion level (YES in S111), the CPU 41 proceeds with the process to S112. In S112, the CPU 41 executes determination process of determining whether the present-state traffic information 27A has been updated by receiving traffic information within the exited link and the distributed traffic congestion level has been changed.

Specifically, the CPU 41 loads the time at which the host vehicle has exited the last link and the time at which the host vehicle has exited the current link from the RAM 42, and, when a time interval from the time at which the host vehicle has exited the last link to the time at which the host vehicle has exited the current link is longer than a predetermined time interval (for example, an interval of five minutes) at which traffic information is distributed, determines that the present-state traffic information 27A has been updated by receiving traffic information within the exited link.

The CPU 41 loads the "distributed traffic congestion level" of the present-state traffic information 27A at the time point at which the host vehicle has exited the last link and the "distributed traffic congestion level" of the present-state traffic information 27A at the time point at which the host vehicle has exited the current link in the traffic information DB 27, and, when there is a mismatch between these distributed traffic congestion levels, determines that the distributed traffic congestion level has been changed.

When it is determined that traffic information has not been received within the exited link and the present-state traffic information 27A has not been updated or the distributed traffic congestion level has not been changed (NO in S112), the CPU 41 proceeds with the process to S113. In S113, the CPU 41 discards the data of the travel traffic congestion level and distributed traffic congestion level of the exited link, that is, initializes the data, and then ends the sub-process, after which the CPU 41 returns the process to the main flowchart and ends the process.

For example, as shown at the center of FIG. 7, when the "travel traffic congestion level" based on the travel speed in a link 82 from which the host vehicle 91 has exited is "heavy congestion," the "distributed traffic congestion level" loaded from the present-state traffic information 27A at the time point at which the host vehicle 91 has exited the link 82 is "no congestion," traffic information has not been received within the exited link 82 and the present-state traffic information 27A has not been updated, the CPU 41 discards the data of the travel traffic congestion level and distributed traffic congestion level and then ends the process.

On the other hand, in S112, when it is determined that the present-state traffic information 27A has been updated by receiving traffic information within the exited link and the distributed traffic congestion level has been changed (YES in S112), the CPU 41 proceeds with the process to S114. In S114, the CPU 41 executes determination process of determining whether the traffic information having the "distributed traffic congestion level" that coincides with the "travel traffic congestion level" has been received within the exited link.

Specifically, the CPU 41 loads the "distributed traffic congestion level" of the previous present-state traffic information 27A that has been received within the exited link from the traffic information DB 27, and, when there is the "distributed traffic congestion level" that coincides with the "travel traffic congestion level" of the exited link, determines that traffic information having the "distributed traffic congestion level" that coincides with the "travel traffic congestion level" has been received within the exited link.

When it is determined that traffic information having the "distributed traffic congestion level" that coincides with the "travel traffic congestion level" has not been received within the exited link (NO in S114), the CPU 41 proceeds with the process to S113. In S113, the CPU 41 discards the data of the travel traffic congestion level and distributed traffic congestion level of the exited link, that is, initializes the data, and then ends the sub-process, after which the CPU 41 returns the process to the main flowchart and ends the process.

On the other hand, when it is determined that traffic information having the "distributed traffic congestion level" that coincides with the "travel traffic congestion level" has been received within the exited link (YES in S114), the CPU 41 proceeds with the process to S115. In S115, the CPU 41 loads the time at which the host vehicle has exited the last link and the time at which the host vehicle has exited the current link from the RAM 42, and loads the dates of receipt and distributed traffic congestion levels of the respective pieces of the present-state traffic information 27A, which have been received and stored in the traffic information DB 27 within the exited links. A trip time for each "distributed traffic congestion level" within the exited link is calculated and stored in the RAM 42.

For example, as shown at the right end in FIG. 7, when the "travel traffic congestion level" based on the travel speed in the link 83 from which the host vehicle 91 has exited is "no congestion" and the "distributed traffic congestion level" of the previous present-state traffic information 27A that has been received within the exited link is "no congestion," the CPU 41 determines that traffic information having the "distributed traffic congestion level" that coincides with the "travel traffic congestion level" has been received within the exited link 83.

Figure 8:
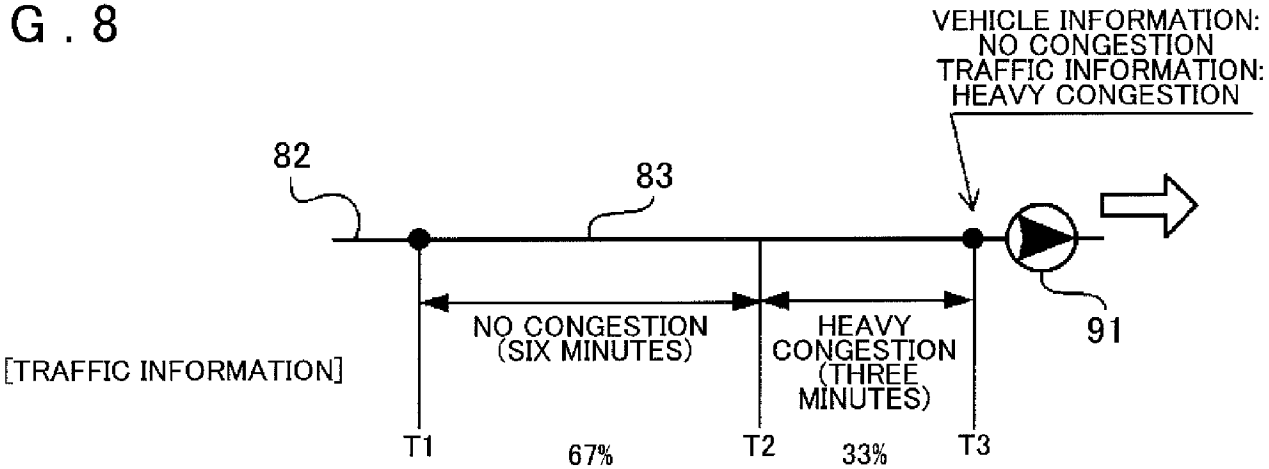
FIG. 8 is a view that shows an example of time rates of distributed traffic congestion levels, shown in FIG. 7.

As shown in FIG. 8, the CPU 41 loads the time T1 at which the host vehicle has exited the link 82 and the time T3 at which the host vehicle has exited the link 83 from the RAM 42, and loads the time T2, at which the current present-state traffic information 27A has been received, from the traffic information DB 27. The CPU 41 calculates trip times (for example, "six minutes" and "three minutes") of the respective "distributed traffic congestion levels," that is, "no congestion" and "heavy congestion," within the exited link 83 from the time T1, time T2 and time T3, and stores the trip times in the RAM 42.

Subsequently, in S116, the CPU 41 loads the trip time of each "distributed traffic congestion level" within the exited link from the RAM 42 again, and calculates a time rate of each "distributed traffic congestion level." After that, the CPU 41 executes determination process of determining whether there is a distributed traffic congestion level of which the time rate is 80% or above (hereinafter, referred to as "first specific traffic congestion level") among the time rates of the respective "distributed traffic congestion levels" within the exited link. Note that the determination time rate of the first specific traffic congestion level is not limited to 80% or above; it may be set to any time rate that is, for example, 70% or above to 95% or above.

When it is determined that there is a first specific traffic congestion level of which the time rate is 80% or above among the time rates of the respective "distributed traffic congestion levels" within the exited link (YES in S116), the CPU 41 sets the first specific traffic congestion level as a "specific traffic congestion level" of the exited link and stores the first specific traffic congestion level in the RAM 42, after which the CPU 41 proceeds with the process to S117. In S117, the CPU 41 loads the "travel traffic congestion level" and the "specific traffic congestion level" from the RAM 42, and executes determination process of determining whether the "travel traffic congestion level" and "specific traffic congestion level" of the exited link coincide with each other.

When it is determined that the "travel traffic congestion level" and "specific traffic congestion level" of the exited link do not coincide with each other (NO in S117), the CPU 41 proceeds with the process to S113. In S113, the CPU 41 discards the data of the travel traffic congestion level, distributed traffic congestion level and specific traffic congestion level of the exited link, that is, initializes the data, and then ends the sub-process, after which the CPU 41 returns the process to the main flowchart and ends the process.

On the other hand, when it is determined that the "travel traffic congestion level" and "specific traffic congestion level" of the exited link coincide with each other (YES in S117), the CPU 41 proceeds with the process to S118. In S118, the CPU 41 loads the "link ID" of the exited link, the "specific traffic congestion level" and the "fuel consumption" in the exited link from the RAM 42. The CPU 41 sets the loaded "link ID" as the "link ID" of the traffic congestion level learning table 71, stores the "specific traffic congestion level" of the exited link in the corresponding "traffic congestion level" of the traffic congestion level learning table 71 as the "traffic congestion level" of the intended link, and stores the "fuel consumption" of the exited link as the "consumption energy."

The CPU 41 stores a number that indicates a turn, at which data are stored, as the "management number" of the traffic congestion level learning table 71, corresponding to the "specific traffic congestion level," and stores a number that indicates a turn, at which the "specific traffic congestion level" is stored, as the "number of travels." After that, the CPU 41 ends the sub-process, returns the process to the main flowchart, and ends the process.

On the other hand, in S116, when it is determined that there is no first specific traffic congestion level of which the time rate is 80% or above among the time rates of the respective "distributed traffic congestion levels" within the exited link (NO in S116), the CPU 41 proceeds with the process to S119.

In S119, the CPU 41 loads the road type of the exited link, stored in the RAM 42 in S13, and loads the thresholds of the travel speeds of the respective traffic congestion levels, associated with the road type of the exited link, from the traffic congestion level computing table 72. The CPU 41 calculates a travel distance for each "distributed traffic congestion level" within the exited link by multiplying the trip time of each "distributed traffic congestion level" within the exited link by the threshold of the travel speed of the corresponding traffic congestion level, and stores the travel distance of each "distributed traffic congestion level" in the RAM 42. Note that the CPU 41 may be configured to calculate a travel distance of each "distributed traffic congestion level" from a travel speed of the host vehicle for each "distributed traffic congestion level" within the exited link.

For example, as shown in FIG. 8, when the time rates of the respective "distributed traffic congestion levels" of which the trip times are respectively "six minutes" for "no congestion" and "three minutes" for "heavy congestion" within the exited link 83 are respectively "67%" and "33%" and the exited link 83 is an ordinary road, the CPU 41 loads the threshold "10 km/h" between "heavy congestion" and "congestion" and the threshold "20 km/h" between "congestion" and "no congestion" from the traffic congestion level computing table 72 and stores the thresholds in the RAM 42.

Figure 9:
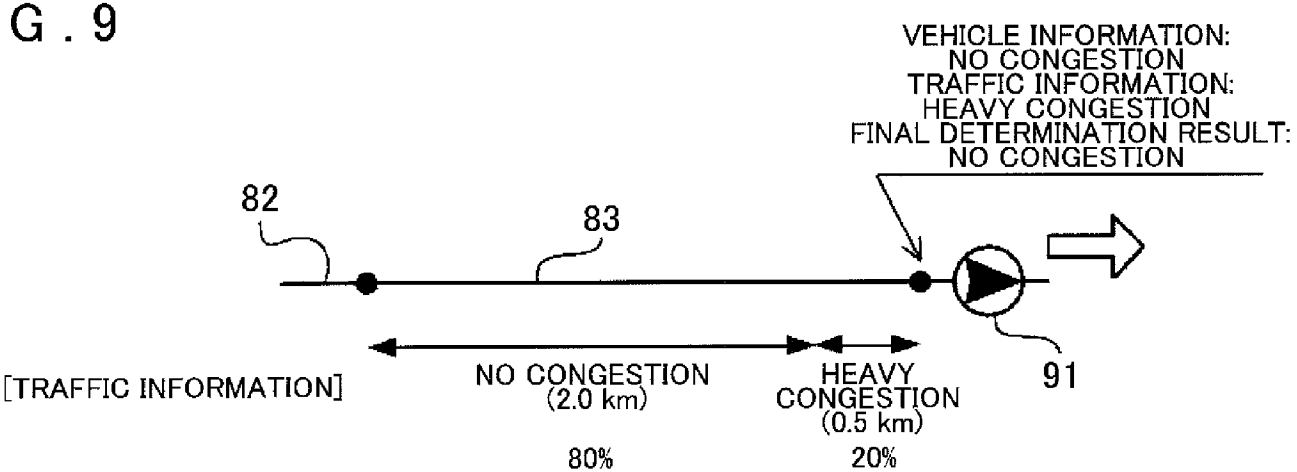
FIG. 9 is a view that shows an example in which a traffic congestion level of the exited link is determined on the basis of distance rates shown in FIG. 8.

As shown in FIG. 9, the CPU 41 calculates a travel distance "2 km" at the time when the "distributed traffic congestion level" is "no congestion" by multiplying "six minutes" for "no congestion" by the threshold "20 km/h," and stores the travel distance in the RAM 42. In addition, the CPU 41 calculates a travel distance "0.5 km" at the time when the "distributed traffic congestion level" is "heavy congestion" by multiplying "three minutes" for "heavy congestion" by the threshold "10 km/h" and stores the travel distance in the RAM 42.

Subsequently, in S120, the CPU 41 loads the travel distance of each "distributed traffic congestion level" within the exited link from the RAM 42 again, and calculates a distance rate of each "distributed traffic congestion level." After that, the CPU 41 executes determination process of determining whether there is a distributed traffic congestion level of which the distance rate is 80% or above (hereinafter, referred to as "second specific traffic congestion level") among the distance rates of the respective "distributed traffic congestion levels" within the exited link. Note that the determination distance rate of the second specific traffic congestion level is not limited to 80% or above; it may be set to any distance rate that is, for example, 70% or above to 95% or above.

When it is determined that there is no second specific traffic congestion level of which the distance rate is 80% or above among the distance rates of the respective "distributed traffic congestion levels" (NO in S120), the CPU 41 proceeds with the process to S113. In S113, the CPU 41 discards the data of the travel traffic congestion level and distributed traffic congestion level of the exited link, that is, initializes the data, and then ends the sub-process, after which the CPU 41 returns the process to the main flowchart and ends the process.

On the other hand, when it is determined that there is a second traffic congestion level of which the distance rate is 80% or above among the distance rates of the respective "distributed traffic congestion levels" within the exited link (YES in S120), the CPU 41 stores the second specific traffic congestion level in the RAM 42 as the "specific traffic congestion level" of the exited link, and then executes processes in S117 and the following steps.

For example, as shown in FIG. 9, when the distance rates of the respective "distributed traffic congestion levels" of which the travel distances are respectively "2 km" for "no congestion" and "0.5 km" for "heavy congestion" within the exited link 83 are respectively "80%" and "20%, the CPU 41 sets the "no congestion" of the "distributed traffic congestion level" as the "second specific traffic congestion level." The CPU 41 stores the second specific traffic congestion level "no congestion" in the RAM 42 as the "specific traffic congestion level," and then executes processes in S117 and the following steps.

As described above, in the navigation system 1 according to the present example, when the distributed traffic congestion level of the exited link coincides with the travel traffic congestion level of the exited link, the CPU 41 stores the distributed traffic congestion level and the fuel consumption in the traffic congestion level learning table 71 in association with the link ID of the exited link. When the traffic information has been updated on the way of passage of the link and the distributed traffic congestion level at the time point at which the host vehicle has exited the link does not coincide with the travel traffic congestion level at the time when the host vehicle has exited the link, the CPU 41 calculates the time rate of each distributed traffic congestion level within the exited link.

When there is a first specific traffic congestion level of which the time rate is 80% or above among the time rates of the respective distributed traffic congestion levels within the exited link, the CPU 41 sets the first specific traffic congestion level as the "specific traffic congestion level." When the "specific traffic congestion level" coincides with the travel traffic congestion level of the exited link, the CPU 41 determines the specific traffic congestion level as the "traffic congestion level" of the exited link, and stores the specific traffic congestion level and the fuel consumption in the traffic congestion level learning table 71 in association with the link ID of the exited link. By so doing, even when the traffic information has been updated on the way of passage of the link, it is possible to highly accurately determine the traffic congestion level of the link, and to store the specific traffic congestion level (distributed traffic congestion level) and the fuel consumption in the traffic congestion level learning table 71 in association with the link ID of the exited link.

When there is no first specific traffic congestion level of which the time rate is 80% or above among the time rates of the respective distributed traffic congestion levels within the exited link, the CPU 41 converts the time rates of the respective distributed traffic congestion levels within the exited link to distance rates of respective travel distances. When there is a second specific traffic congestion level of which the distance rate is 80% or above among the distance rates of the respective distributed traffic congestion levels within the exited link, the CPU 41 sets the second specific traffic congestion level as the "specific traffic congestion level." When the "specific traffic congestion level" coincides with the travel traffic congestion level of the exited link, the CPU 41 determines the specific traffic congestion level as the "traffic congestion level" of the exited link.

Subsequently, the CPU 41 stores the specific traffic congestion level and the fuel consumption in the traffic congestion level learning table 71 in association with the link ID of the exited link. By so doing, even when traffic information has been updated on the way of passage of a link, it is possible to further highly accurately determine the traffic congestion level of the link and to store the specific traffic congestion level (distributed traffic congestion level) and the fuel consumption in the traffic congestion level learning table 71 in association with the link ID of the exited link.

3. Modifications

While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying inventive principles.

For example, when it is determined in S114 that traffic information having the "distributed traffic congestion level" that coincides with the "travel traffic congestion level" has been received within the exited link (YES in S114), the CPU 41 may execute the process of S115 and then proceed with the process to S119. That is, the CPU 41 may be configured not to execute the process of S116.

Thus, the CPU 41 converts the time rate of each distributed traffic congestion level within the exited link to the distance rate of a travel distance. When there is a second specific traffic congestion level of which the distance rate is 80% or above among the distance rates of the respective distributed traffic congestion levels within the exited link and the second specific traffic congestion level coincides with the travel traffic congestion level of the exited link, the CPU 41 determines the second specific traffic congestion level as the "specific traffic congestion level" of the exited link.

Subsequently, the CPU 41 stores the specific traffic congestion level and the fuel consumption in the traffic congestion level learning table 71 in association with the link ID of the exited link. By so doing, even when traffic information has been updated on the way of passage of a link, it is possible to highly accurately determine the traffic congestion level of the link and to store the specific traffic congestion level (distributed traffic congestion level) and the fuel consumption in the traffic congestion level learning table 71 in association with the link ID of the exited link.

4. Advantages

With the traffic information creating device and/or method described above, when the traffic information has been updated on the way of passage of a link and the travel traffic congestion level within the link, acquired on the basis of the travel information of the exited link, does not coincide with the distributed traffic congestion level of the traffic information at the time point at which the vehicle has exited the link, the traffic congestion level of the exited link is determined on the basis of the distribution time rate of each distributed traffic congestion level within the exited link and the travel traffic congestion level of the exited link, and is stored in association with the link. By so doing, even when the traffic information has been updated on the way of passage of a link and the distributed traffic congestion level has been changed, it is possible to highly accurately determine the traffic congestion level of the link and store the traffic congestion level of the link.

When there is the first specific traffic congestion level of which the distribution time rate is the predetermined rate or above among the distribution time rates of the respective distributed traffic congestion levels within the exited link and the first specific traffic congestion level coincides with the travel traffic congestion level of the exited link, the first specific traffic congestion level is determined as the traffic congestion level of the exited link. By so doing, even when the traffic information has been updated on the way of passage of a link, it is possible to highly accurately determine the traffic congestion level of the link.

Further, even when there is no first specific traffic congestion level, the time rate of each distributed traffic congestion level within the exited link is converted to a distance rate and then the traffic congestion level of the exited link is determined on the basis of the distance rate of each distributed traffic congestion level within the exited link and the travel traffic congestion level of the exited link. By so doing, even when the traffic information has been updated on the way of passage of a link and the distributed traffic congestion level has been changed, it is possible to further highly accurately determine the traffic congestion level of the link.

When there is the second specific traffic congestion level of which the distance rate is the predetermined rate or above among the distance rates of the respective distributed traffic congestion levels within the exited link and the second specific traffic congestion level coincides with the travel traffic congestion level of the exited link, the second specific traffic congestion level is determined as the traffic congestion level of the exited link. By so doing, even when the traffic information has been updated on the way of passage of a link, it is possible to further highly accurately determine the traffic congestion level of the link.

The time rate of each distributed traffic congestion level within the exited link is converted to a distance rate, and, when there is the specific traffic congestion level of which the distance rate is the predetermined rate or above among the distance rates of the respective distributed traffic congestion levels and the specific traffic congestion level coincides with the travel traffic congestion level of the exited link, the specific traffic congestion level is determined as the traffic congestion level of the exited link. By so doing, even when the traffic information has been updated on the way of passage of a link, it is possible to further highly accurately determine the traffic congestion level of the link.

What is claimed is:

1. A traffic information creating device comprising:

a memory that stores map information including link information related to links that constitute a road; and a controller that:

acquires travel information including a current location of a vehicle and a vehicle speed of the vehicle at unit time intervals;

acquires traffic information, which includes a distributed traffic congestion level of each link and which is distributed from a device outside the vehicle at predetermined time intervals;

determines whether the vehicle has exited a link on the basis of the map information;

when it is determined that the vehicle has exited the link, acquires a travel traffic congestion level of the exited link on the basis of the travel information within the exited link;

determines whether the travel traffic congestion level of the exited link coincides with the distributed traffic congestion level at a time point at which the vehicle has exited the link;

when it is determined that the travel traffic congestion level of the exited link does not coincide with the distributed traffic congestion level at the time point at which the vehicle has exited the link, determines whether the traffic information has been updated and the distributed traffic congestion level has been changed within the exited link;

when it is determined that the traffic information has been updated and the distributed traffic congestion level has been changed within the exited link, acquires a distribution time rate of each distributed traffic congestion level within the exited link, the distribution time rate for each distributed traffic congestion level indicating a relative amount of travel time along the link having that distributed traffic congestion level;

determines a traffic congestion level of the exited link on the basis of the distribution time rate of each acquired distributed traffic congestion level and the travel traffic congestion level of the exited link; and stores the determined traffic congestion level of the exited link in association with the exited link.

2. The traffic information creating device according to claim 1, wherein the controller:

determines, from among the distribution time rates of the respective distributed traffic congestion levels within the exited link, whether there is a first specific traffic congestion level of which the distribution time rate is greater than or equal to a predetermined distribution time rate; and when it is determined that there is the first specific traffic congestion level, determines whether the first specific traffic congestion level coincides with the travel traffic congestion level of the exited link; and when it is determined that the first specific traffic congestion level coincides with the travel traffic congestion level of the exited link, determines the first specific traffic congestion level as the traffic congestion level of the exited link.

3. The traffic information creating device according to claim 2, wherein the controller:

when it is determined that there is no first specific traffic congestion level, converts the distribution time rate of each distributed traffic congestion level within the exited link to a distance rate, the distance rate for each distributed traffic congestion level indicating a relative length of the link having that distributed traffic congestion level; and determines the traffic congestion level of the exited link on the basis of the converted distance rate of each distributed traffic congestion level within the exited link and the travel traffic congestion level of the exited link.

4. The traffic information creating device according to claim 3, wherein the controller:

determines, from among the converted distance rates of the respective distributed traffic congestion levels within the exited link, whether there is a second specific traffic congestion level of which the distance rate is greater than or equal to a predetermined distance rate; and when it is determined that there is the second specific traffic congestion level, determines whether the second specific traffic congestion level coincides with the travel traffic congestion level of the exited link; and when it is determined that the second specific traffic congestion level coincides with the travel traffic congestion level of the exited link, determines the second specific traffic congestion level as the traffic congestion level of the exited link.

5. The traffic information creating device according to claim 1, wherein the controller:

converts the distribution time rate of each distributed traffic congestion level within the exited link to a distance rate, the distance rate for each distributed traffic congestion level indicating a relative length of the link having that distributed traffic congestion level;

determines, from among the converted distance rates of the respective distributed traffic congestion levels within the exited link, whether there is a specific traffic congestion level of which the distance rate is greater than or equal to a predetermined distance rate;

when it is determined that there is the specific traffic congestion level, determines whether the specific traffic congestion level coincides with the travel traffic congestion level of the exited link; and when it is determined that the specific traffic congestion level coincides with the travel traffic congestion level of the exited link, determines the specific traffic congestion level as the traffic congestion level of the exited link.

6. A traffic information creating method comprising:

accessing stored map information including link information related to links that constitute a road;

acquiring travel information including a current location of a vehicle and a vehicle speed of the vehicle at unit time intervals;

acquiring traffic information, which includes a distributed traffic congestion level of each link and which is distributed from a device outside the vehicle at predetermined time intervals;

determining whether the vehicle has exited a link on the basis of the map information;

when it is determined that the vehicle has exited the link, acquiring a travel traffic congestion level of the exited link on the basis of the travel information within the exited link;

determining whether the travel traffic congestion level of the exited link coincides with the distributed traffic congestion level at a time point at which the vehicle has exited the link;

when it is determined that the travel traffic congestion level of the exited link does not coincide with the distributed traffic congestion level at the time point at which the vehicle has exited the link, determining whether the traffic information has been updated and the distributed traffic congestion level has been changed within the exited link;

when it is determined that the traffic information has been updated and the distributed traffic congestion level has been changed within the exited link, acquiring a distribution time rate of each distributed traffic congestion level within the exited link, the distribution time rate for each distributed traffic congestion level indicating a relative amount of travel time along the link having that distributed traffic congestion level;

determining a traffic congestion level of the exited link on the basis of the distribution time rate of each acquired distributed traffic congestion level and the travel traffic congestion level of the exited link; and storing the determined traffic congestion level of the exited link in association with the exited link.

7. The traffic information creating method according to claim 6, further comprising:

determining, from among the distribution time rates of the respective distributed traffic congestion levels within the exited link, whether there is a first specific traffic congestion level of which the distribution time rate is greater than or equal to a predetermined distribution time rate; and when it is determined that there is the first specific traffic congestion level, determining whether the first specific traffic congestion level coincides with the travel traffic congestion level of the exited link; and when it is determined that the first specific traffic congestion level coincides with the travel traffic congestion level of the exited link, determining the first specific traffic congestion level as the traffic congestion level of the exited link.

8. The traffic information creating method according to claim 7, further comprising:

when it is determined that there is no first specific traffic congestion level, converting the distribution time rate of each distributed traffic congestion level within the exited link to a distance rate, the distance rate for each distributed traffic congestion level indicating a relative length of the link having that distributed traffic congestion level; and determining the traffic congestion level of the exited link on the basis of the converted distance rate of each distributed traffic congestion level within the exited link and the travel traffic congestion level of the exited link.

9. The traffic information creating method according to claim 8, further comprising:

determining, from among the converted distance rates of the respective distributed traffic congestion levels within the exited link, whether there is a second specific traffic congestion level of which the distance rate is greater than or equal to a predetermined distance rate;

when it is determined that there is the second specific traffic congestion level, determining whether the second specific traffic congestion level coincides with the travel traffic congestion level of the exited link; and when it is determined that the second specific traffic congestion level coincides with the travel traffic congestion level of the exited link, determining the second specific traffic congestion level as the traffic congestion level of the exited link.

10. The traffic information creating method according to claim 6, further comprising:

converting the distribution time rate of each distributed traffic congestion level within the exited link to a distance rate, the distance rate for each distributed traffic congestion level indicating a relative length of the link having that distributed traffic congestion level;

determining, from among the converted distance rates of the respective distributed traffic congestion levels within the exited link, whether there is a specific traffic congestion level of which the distance rate is greater than or equal to a predetermined distance rate;

when it is determined that there is the specific traffic congestion level, determining whether the specific traffic congestion level coincides with the travel traffic congestion level of the exited link; and when it is determined that the specific traffic congestion level coincides with the travel traffic congestion level of the exited link, determining the specific traffic congestion level as the traffic congestion level of the exited link.

11. A non-transitory computer-readable storage device storing a computer-executable program for creating traffic information, the program comprising:

instructions for accessing stored map information including link information related to links that constitute a road;

instructions for acquiring travel information including a current location of a vehicle and a vehicle speed of the vehicle at unit time intervals;

instructions for acquiring traffic information, which includes a distributed traffic congestion level of each link and which is distributed from a device outside the vehicle at predetermined time intervals;

instructions for determining whether the vehicle has exited a link on the basis of the map information;

instructions for, when it is determined that the vehicle has exited the link, acquiring a travel traffic congestion level of the exited link on the basis of the travel information within the exited link;

instructions for determining whether the travel traffic congestion level of the exited link coincides with the distributed traffic congestion level at a time point at which the vehicle has exited the link;

instructions for, when it is determined that the travel traffic congestion level of the exited link does not coincide with the distributed traffic congestion level at the time point at which the vehicle has exited the link, determining whether the traffic information has been updated and the distributed traffic congestion level has been changed within the exited link;

instructions for, when it is determined that the traffic information has been updated and the distributed traffic congestion level has been changed within the exited link, acquiring a distribution time rate of each distributed traffic congestion level within the exited link, the distribution time rate for each distributed traffic congestion level indicating a relative amount of travel time along the link having that distributed traffic congestion level;

instructions for determining a traffic congestion level of the exited link on the basis of the distribution time rate of each acquired distributed traffic congestion level and the travel traffic congestion level of the exited link; and instructions for storing determined the traffic congestion level of the exited link in association with the exited link.

12. The non-transitory computer-readable storage device according to claim 11, the program further comprising:

instructions for determining, from among the distribution time rates of the respective distributed traffic congestion levels within the exited link, whether there is a first specific traffic congestion level of which the distribution time rate is greater than or equal to a predetermined distribution time rate; and instructions for, when it is determined that there is the first specific traffic congestion level, determining whether the first specific traffic congestion level coincides with the travel traffic congestion level of the exited link; and instructions for, when it is determined that the first specific traffic congestion level coincides with the travel traffic congestion level of the exited link, determining the first specific traffic congestion level as the traffic congestion level of the exited link.

13. The non-transitory computer-readable storage device according to claim 12, the program further comprising:

instructions for, when it is determined that there is no first specific traffic congestion level, converting the distribution time rate of each distributed traffic congestion level within the exited link to a distance rate, the distance rate for each distributed traffic congestion level indicating a relative length of the link having that distributed traffic congestion level; and instructions for determining the traffic congestion level of the exited link on the basis of the converted distance rate of each distributed traffic congestion level within the exited link and the travel traffic congestion level of the exited link.

14. The non-transitory computer-readable storage device according to claim 13, the program further comprising:

instructions for determining, from among the converted distance rates of the respective distributed traffic congestion levels within the exited link, whether there is a second specific traffic congestion level of which the distance rate is greater than or equal to a predetermined distance rate;

instructions for, when it is determined that there is the second specific traffic congestion level, determining whether the second specific traffic congestion level coincides with the travel traffic congestion level of the exited link; and instructions for, when it is determined that the second specific traffic congestion level coincides with the travel traffic congestion level of the exited link, determining the second specific traffic congestion level as the traffic congestion level of the exited link.

15. The non-transitory computer-readable storage device according to claim 11, the program further comprising:

instructions for converting the distribution time rate of each distributed traffic congestion level within the exited link to a distance rate, the distance rate for each distributed traffic congestion level indicating a relative length of the link having that distributed traffic congestion level;

instructions for determining, from among the converted distance rates of the respective distributed traffic congestion levels within the exited link, whether there is a specific traffic congestion level of which the distance rate is greater than or equal to a predetermined distance rate;

instructions for, when it is determined that there is the specific traffic congestion level, determining whether the specific traffic congestion level coincides with the travel traffic congestion level of the exited link; and instructions for, when it is determined that the specific traffic congestion level coincides with the travel traffic congestion level of the exited link, determining the specific traffic congestion level as the traffic congestion level of the exited link.

* * * * *